US005647664A

United States Patent [19]

Hanečka

[11] Patent Number: 5,647,664

[45] Date of Patent: Jul. 15, 1997

[54] LIGHTING SYSTEM FOR SPOTLIGHTS AND THE LIKE

[76] Inventor: Miroslav Hanečka, Tyršova 165, 78375 Dub n. Moravou, Czechoslovakia

[21] Appl. No.: 347,379

[22] PCT Filed: Dec. 20, 1993

[86] PCT No.: PCT/CZ93/00031

§ 371 Date: Dec. 5, 1994

§ 102(e) Date: Dec. 5, 1994

[87] PCT Pub. No.: WO94/15143

PCT Pub. Date: Jul. 7, 1994

[30] Foreign Application Priority Data

Dec. 21, 1992 [CS] Czechoslovakia ..... 3780-92

[51] Int. Cl.[6] ..... F21V 7/04

[52] U.S. Cl. ..... 362/308; 362/298; 362/304; 362/346

[58] Field of Search ..... 362/297, 298, 362/299, 308, 309, 328, 333, 346, 348, 300, 304

[56] References Cited

U.S. PATENT DOCUMENTS 3,488,489 1/1970 Jones ..... 362/328

4,035,631 7/1977 Day, Jr. .

FOREIGN PATENT DOCUMENTS 482090 4/1952 Canada ..... 362/308

1034116 7/1958 Germany .

3306481 9/1983 Germany ..... 362/346

1300247 3/1987 U.S.S.R. ..... 362/297

1084778 9/1967 United Kingdom .

*Primary Examiner*—Y My Quach

*Attorney, Agent, or Firm*—Beveridge, DeGrandi, Weilacher & Young, LLP

[57] ABSTRACT

The invention concerns a lighting system for spotlights, for automobile headlights, for medical and industrial spotlights. It consists of the light source (1), particularly the halogen light bulb, auxiliary mirror (2), the main mirror (3), consisting of a system of concave spherical mirrors (31), and a raster lens (4). All of these elements lie on the main optical axis (0). If a system of condensers (5) and an objective (7) is added to the basic part, the system can be used for cinema projectors and enlarging apparatuses.

10 Claims, 3 Drawing Sheets

LIGHTING SYSTEM FOR SPOTLIGHTS AND THE LIKE

BACKGROUND OF THE INVENTION

1. Field of the Invention

The invention concerns a lighting system for lighting fittings, projectors and enlarging apparatuses, which provides an intensive and uniform illumination of a given area at a given distance. It consists of a light source, an auxiliary mirror and the main mirror. Another part of the system is a raster lens, consisting of a net of individual converging lenses, which direct the light rays coming from the source into the required plane, where they create the light spot.

2. The Prior Art

There exist many lighting systems used above all as automobile headlights. These systems are usually made by a continuous parabolic reflector covered by a cover glass with diverging elements. The light source is a halogen bulb with two filaments; one is for distance light and the other one for lower beam with an internal diaphragm that allows limitation of the lower beam. In order to decrease the reflector's vertical size, the classical paraboloidal reflector was remodelled into the shape of a homofocal reflecting surface in such a way that this reflecting surface was divided into a system of discretely connected paraboloidal segments with the same optimized focal length. The need for another decrease of the headlight's size leads to a production of an ellipticdioptric system. Its reflector has a shape of a rotational or polyelliptic ellipsoid with three axes. In one of its focuses there is the filament of the bulb and in the second one there is a diaphragm. The planoconvex lens, situated in the second focus of the ellipse, directs the output light rays so that they are parallel with the optical axis of the system. This lens also projects the diaphragm into the luminous background of the roadway. This process defines distribution of the subdued beam illumination.

As there is only one filament in the bulb, this system can be used for lower beam only. Therefore one more lighting fitting of a similar or the same construction is necesarry for a distance light. The said lighting fitting has a very small height and it creates lower beam of a good intensity and homogenity with a sharp boundary between light cone and darkness. Another lighting fitting with an increased reach of lower beam illumination has a reflector of the type with a freely formed reflecting surface, which is continuous and closed in such a way that, without the influence of a covering glass, the reflector projects to the required space elementary filament of a single filament bulb. Even without the diaphragm, it makes a boundary between darkness and light. Light output capacity of such a system proportionally increases with the size of the reflector and it allows also using of its lower part, what increases the efficiency. Nevertheless, for a distance light an extra lighting fitting is needed. By the use of the conception with freely formed reflecting surface an improved projective elliptical dioptric system of the lighting fitting is achieved. The original ellipsoid is remodelled into a general surface with a higher amount of light beam in the non-diaphragmed part of the focal plane. The reflector is more open in its upper part and more closed in its lower part. The light ouput of such a system is much higher in comparison with the previous system.

Similar lighting systems can be used for different illuminating purposes, e.g. in the health service, as spotlights used in stomatology. These systems consist of a known type of planary lighting fittings using mostly as light sources a halogen bulb, and a cold reflecting concave mirror. Its reflecting part is arranged as raster mirror, which directs the light spot into the required plane.

The main disadvantage of present automobile lighting systems consists in their low luminous efficiency. Moving vehicles use the light beam, reflected by differently shaped mirrors, and the luminous flux coming out of light source straight ahead is not used and is therefore often shaded. Dazzling effect is another big disadvantage of such a lighting fittings, since almost all systems used so far give out an intensive light coming from the filament of the bulb, which is visible from the space in front of the spotlight. Both interface between light and darkness and the uniformity of light beam intensity are difficult to obtain, the consequence of which is rather complicated systems. The big size of these lighting fittings and the slope of their cover glasses make suitable aerodynamic designing of the front part of the automobile to be a rather difficult task.

Spotlights used in stomatology have similarly low luminous efficiency. The light, coming from the light source, is directed to the front space and, therefore, stays unused. When the light is turned on, the light beam reaches also the patient's eyes and causes unpleasant dazzle. The dentist's mirror can also reflect unwanted light from different mirroring surfaces; thus the observed image can be disturbed. During some elemental operations, e.g. during preparation of the crown, the light, reflected from the metal, creates a certain kind of barrier between the preparation opening and the reflecting surface of the crown. This makes dental operation more difficult. The reflectors with raster mirrors are relatively big; when the lighting fitting is adjusted into an inapropriate position, the dentist can easily interrupt the light beam with his head and decrease the amount of light coming out from the lighting fittings and shining onto the desired spot on patient's body.

If another optical system, for example a system of condensors, is added to one of the systems mentioned and described above, the resulting system could be used for illumination of the object plane, in which a field of negative or positive filmstrip is inserted. Such field is then projected, by means of an objective, into the image plane. This lighting system is suitable mainly for projectors, slide projectors and enlarging apparatuses.

There are slide projectors of big formats with intensive light sources. Their structure and different luminance of the light source influence negatively the uniformity ratio of illumination of the object plane. Therefore, such lighting systems contain optical parts with raster members, and instead of a simple convex mirror, a raster mirror is used. Moreover, between two deflecting mirrors an intermediate image-forming system, consisting of two plates with raster lenses can be placed. For big format slides, a honeycombed condenser system, consisting of a raster lens, is mostly used. There are also used lighting systems made with one of the honeycombs as a raster mirror. The mirror consists of groups of curved reflecting raster surfaces, placed in one plane. The disadvantage of these systems is above all their big size and high number of complicated optical elements, what is the cause of bigger loss of the luminous flux as well.

In slide projectors of small formats are for illuminating systems used both spherical mirror with a light source and lens condenser system with an aspherical element and with a thermal filter. The disadvantage of such optical systems consists in the fact that the rectangular frame with film strip placed in the first principal plane, is illuminated by a light beam of a circular shape, which causes a loss of luminous flux. The angle of the luminous flux is furthermore limited by the marginal rays, caught by a spherical or aspherical condensor, and therefore this angle cannot be further increased.

In enlarging apparatuses, dedicated above all to amateurs, mostly the light sources for large areas are used, particularly opal lamps with a lens condenser system, or lamps with elliptic reflecting area. In some enlarging apparatuses can be used an independent head for a colour photography with its own light source, usually a halogen bulb with a diverging system, a mixing chamber for continuously adjustable colour filtration with an adjustable density diaphragm. Yet, such systems have very little light efficiency.

OBJECTS OF THE INVENTION

The present lighting systems are limited by the disadvantages just outlined. The subject matter of our invention consists in that the main mirror, whose optical axis is identical with the main optical axis, on which the light source with the auxiliary mirror is positioned, has its concave reflecting surface formed as a raster mirror. This raster mirror consists of a system of concave spherical mirrors, whose side walls touch one another and whose vertexes are arranged on the surface, which has in the meridional plane a shape of a non-circle curve. The particular reflecting surfaces of the concave reflecting mirrors have such a focal length and such an angle of inclination of the optical axis that they create the optical image of a light source in the vertexes of the geometrically corresponding lenses of the raster lens, which consists of a network of individual lenses and which also lies on the main optical axis. Relevant elementar surfaces of the concave spherical mirrors are projected into the required plane of the light spot.

When looking in the direction of the main optical axis and in an imaginary plane perpendicular to the main axis, each concave spherical mirror shape corresponds to the contour of plane of the projected light spot. The concave spherical mirror are further arranged in zones. Radii of curvature of these mirrors in one zone are equal, but differ from those of another zone.

Individual lenses of the raster lens have the same shape and size and they maximally correspond to the shape and size of the field of the light source. They are also arranged in zones, which can be shifted in a direction of the main axis. The radii of curvature of lenses of one zone differ from the radii of curvature of lenses of another zone. Vertexes of all lenses are arranged in one plane, perpendicular to the main optical axis and their optical axes are parallel to the main one. Under these circumstances the lenses are planoconvex. The back surface of particular lenses of the raster lens can be for certain types of lighting systems inclined to their optical axes in order to create an optical wedge. It is also possible to make the whole back surface of the raster lens concave. Alternatives of arrangement of raster lens described above lead to the most suitable directing of the light spot into a required plane.

In case of using the lighting system for projecting purposes, particularly in slide projectors and enlarging apparatuses, a system of condensers can be added to the lighting system, which directs the luminous spot to a plane, in which a slide is placed.

The main advantage of the inventive lighting system consists in its luminous efficiency at a uniform light distribution in the light spot in a selected plane with minimal dazzling effect. The size of the system is very small both when using this new system to the direct illumination, e.g. for mobile headlights or medicine spotlights, and with an added condenser system.

DETAILED DESCRIPTION OF THE PREFERRED EMBODIMENT

Figure 1:
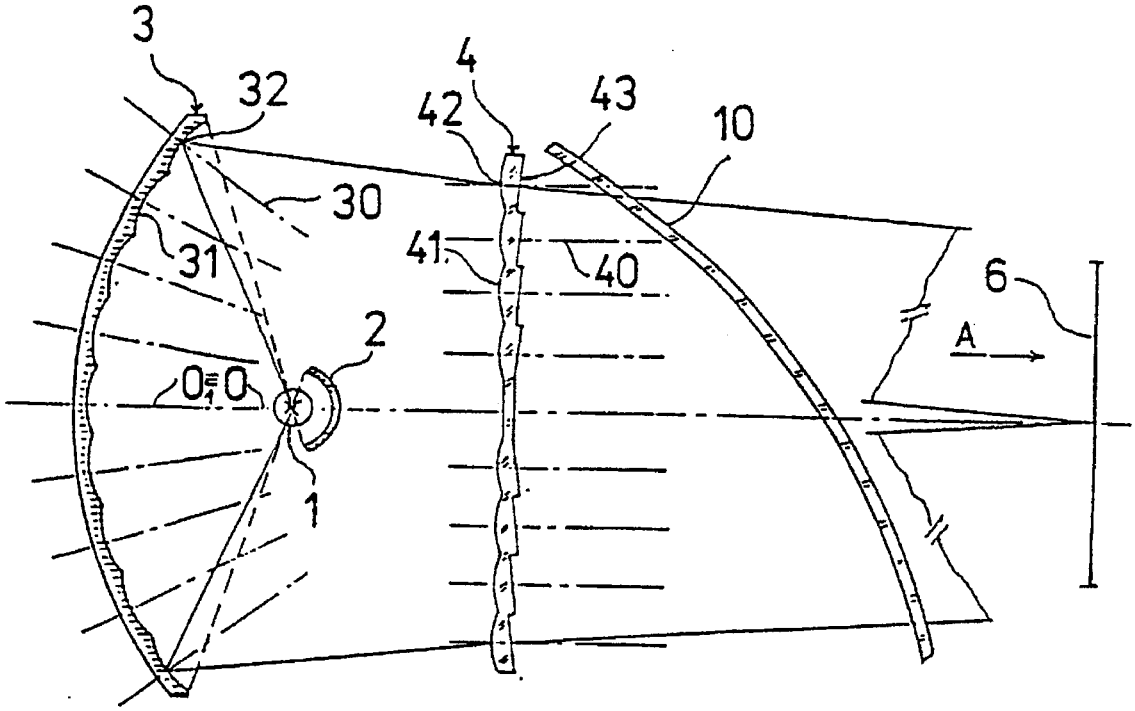
FIG. 1 is a schematic picture of lighting fittings of an automobile headlight.

FIG. 1 schematically shows a lighting system for moving vehicles, especially an automobile headlight optical system. It consists of the light source 1, which is a single filament halogen bulb, placed on the main optical axis 0, on which is arranged an auxiliary mirror 2 as well. Another part of the system is the main mirror 3, whose optical axis $\mathbf{0}_1$ is identical with the main optical axis 0. It is made as a raster mirror, formed by a network of concave mirrors 31 of a rectangular shape, whose side walls tightly abut on each other and whose vertexes 32 are arranged in an imaginary plane, making an aspherical curve in the meridian plane, rotary symetrical around the optical axis $\mathbf{0}_1$, identical with the main optical axis 0. Another part is a raster lens 4, placed at the main optical axis 0 as well. It consists of a system of lenses 41 of converging optical power, which have hexagonal shapes. Again, their side walls abut tightly on each other. Their vertexes 42 are arranged in a common plane, perpendicular to the main optical axis 0, and their back walls 43 are bevelled, so that they make optical wedges. All optical axes 40 are parallel to the main optical axis 0.

Between the mirror 3 and the raster lens 4 a condition must be fulfilled that the optical centers of the lenses 41 and the optical centers of the concave mirrors 31 make dot networks of the similar shape and that a ray, coming from the middle of the light source 1 after reflection from the vertex 32 of the concave mirror 31 is directed towards the vertex 42 of the geometrically corresponding lens 41. The lighting system is completed by a covering dioptrically neutral cover glass 10.

A beam of luminous rays, coming from the light source 1, including the part reflected from the reflecting surface of the auxiliary mirror 2, impinges onto the reflecting surface of the main mirror 3. Each of its concave mirrors 31 creates an image of the light source 1 in the correspodning lens 41 of the raster lens 4, which projects the rectangular concave mirror 31 at a given magnification to the plane of the light spot 6. Through this plane passes the beam of luminous rays in the shape of concave mirrors 31 of the main mirror 3. The same amount of images as is the number of concave mirrors 31 or the lenses 41 is concentrated here. This is valid both for lighting fittings to illumination on a highway with distance lights and lower beams.

Figure 2:
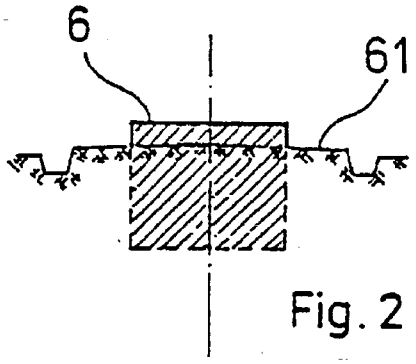
FIG. 2 is a light spot of a lighting system of a distance light of an automobile for an illumination of a distant part of the highway.

As can be seen in FIG. 2, the spot of a lighting fitting for cars for illumination a highway profile 61 with a distance light. Such state is enabled by a proper arrangements of the back surfaces 43 of particular lenses 41 of the raster lens 4.

Figure 3:
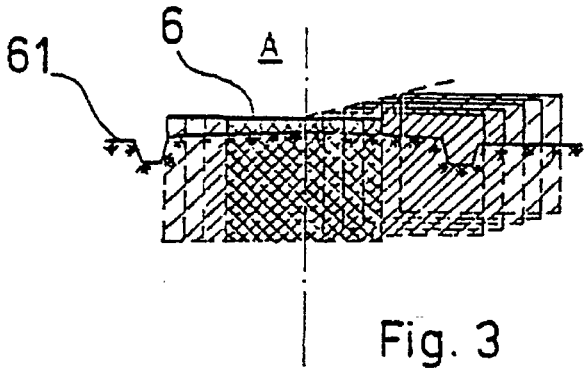
FIG. 3 is a light spot of a lighting fitting for the lower beam of an automobile for a subdued illumination of the highway viewed in the direction A.

FIG. 3 shows the light spot of the lighting fitting for cars for illumination of the highway with the lower beam. Out of the picture follows that there is a higher concentration of the light spots in the central part of the plane than in the outer parts. This is also reached by a proper arrangement of the back surfaces 43 of the raster lens 4.

The main advantage of this headlight lighting system is its ability to reach a higher luminous efficiency by using luminous rays reflected both from the main and auxiliary mirror and by a proper directing of the luminous flux to the required area. The luminous flux is directed only in the direction of the light spot without any disturbing and unnecessary lateral exposures. In a lighting fitting for a lower beam a very well confined border between light and dark areas and an optimally chosen light spot has been achieved. Such a lighting fitting is also suitable for track vehicles, wheel vehicles and military vehicles, where there is a mechanical diaphragm with relevant openings placed behind the dioptrically neutral cover glass, to properly direct and dim the luminous flux according to requirements of the user.

In headlights for illumination with distance light, the light spot is concentrated into one figure. It is totally uniform and independent of the shape and distribution of light from the luminous source. The dazzling effect on the on-coming cars or on oneself is decreased to a minimum level, as only the particular illuminated surfaces of the concave mirrors are projected into the plane of the light spot, while the intensive brightness of the light bulb filament doesn't create an image in the space in front of the lighting fitting. The outer front dimension of the lighting fitting for illumination a highway with a lower beam with a single-filament halogen light bulb is comparable with other advanced projecting systems. When the lighting area of the luminous source is reduced, for example when using a gas discharge lamp, it is possible to decrease the front size of the lighting fitting. The cover glass without diverging elements is optically neutral and allows to increase the vertical and horizontal angle of tilting. This faciliates the solution of the aerodynamical design of the whole lighting fitting and, therefore, also of the front radiator cover of a car.

Figure 4:
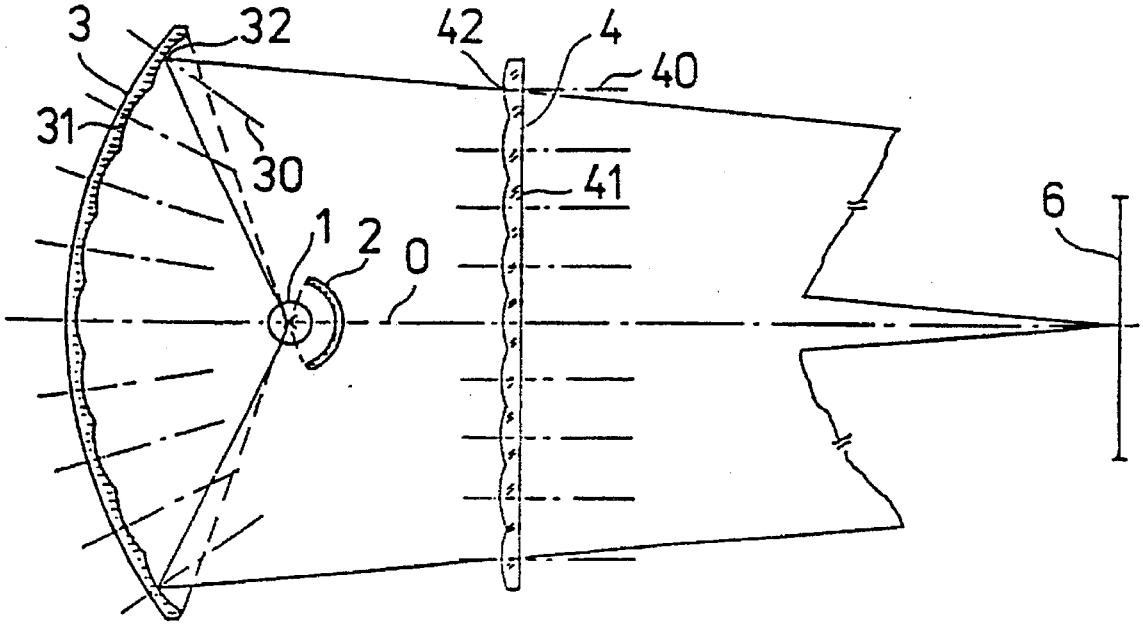
FIG. 4 is a schematic picture of a lighting system of spotlight used in health service.

This idea of a lighting system with only slight changes is also suitable for medical use, especially for stomatology, as could be seen in FIG. 4. After proper adjustment of the concave mirrors 31 of the main mirror 3 and the lenses 41 of the raster lens 4 it is possible to have the whole back surface of this raster lens 4 in the shape of a plane. The plane of the light spot is then uniformly illuminated. In the distance of 900 mm its dimensions reach up to 125×140 mm, what is the optimal size for stamotology. In this case, the sharp boundary between the light and dark area is reached, and dazzling of the patient is minimal.

The lighting system can also be used in many other illumination technic areas where minimal dazzling and uniform lighting of the luminous flux are needed, e.g. in television studios, in film and photographic studios, or workshops as theatre and film spotlights etc., where minimum dazzling and uniform illumination of the light spot in a given distance is being required.

Figure 5:
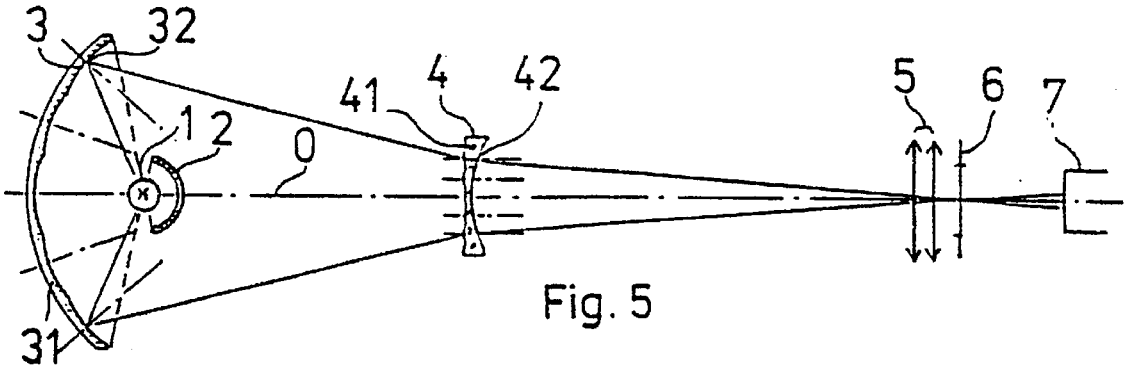
FIG. 5 is a schematic picture of a lighting system for a big format slide projector.

If a condenser set is added to the above described lighting system, it may also be used for slide projectors or for projecting large size images, as shown in FIG. 5.

Such lighting system uses a high-pressure discharge lamp as the light source 1, an auxiliary mirror 2 and an intermediate projecting system, containing the main mirror 3, which is formed by a system of concave spherical mirrors 31, and the raster lens 4, consisting of a system of lenses 41. All these members are arranged on the main optical axis 0. The whole system and also the relations among the particular members are similar to that of the lighting system used for lighting fittings of automobiles or for medicals lamps. Only the back surface of the raster lens 4 is made as diverging. This system is linked up to the condenser system 5, arranged on the main optical axis 0. It is composed of two convex lenses, the back one of which is exchangeable according to the focal length of the used objective 7.

Rays coming from the middle of the light source 1 and later reflected from the centres of the concave mirrors 31 of the main mirror 3 come through the geometrically corresponding convex lenses 41 of the raster lens 4 with a diverging lens and through a condensor system 5, intersect approximately the middle of the plane of the light spot 6, where a slide is placed, which should be projected with help of the objective 7 to an image forming plane (not shown). In this system it is necessary that the ratio of the diameter of the outcoming light beam, coming from the raster lens 4, to the distance of the condenser system 5 from the raster lens 4, is equal to or smaller than the value of the relative opening of the objective 7. The number of concave mirrors 31 or number of lenses 41 determine the number of concave mirror 31 images concentrated in the plane of light spot 6 by projection of the number of lenses 41 of raster lens 4. This results in using practically the whole luminous flux with a highly uniform distribution of light and in a short total length of the whole system.

Figure 6:
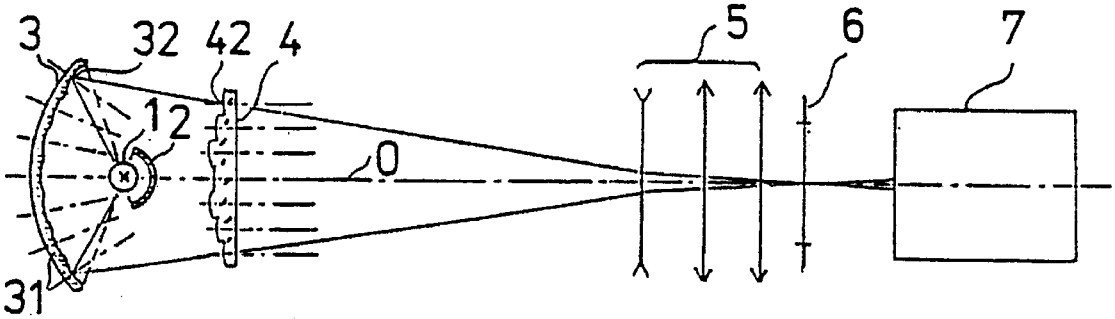
FIG. 6 is a schematic picture of a lighting system for a small format slide projector.

As follows from FIG. 6, it is possible to use this lighting system, after certain modifications, for small format slide projectors. The idea and the description are similar to the above described case. There are nevertheless certain differences in the construction of the main mirror 3, of the raster lens 4 and of the condenser system 5. A halogen light bulb is used as the light source 1. The main mirror 3 consists of rectangular concave mirrors 31 of the same size, which are arranged in lines, the neighbouring lines being displaced half of the width of one mirror 31. The geometrical centres of the mirrors 31 make a raster similar to the geometrical network of lenses 41 of the raster lens 4. These concave mirrors 31 whose vertexes 32 are arranged on an aspherical surface and whose optical centres are identical with the geometrical centres, lie at different radii from the main optical axis 0. At the same time these concave mirrors 31 form zones with different focal distances, in order to project the light source 1 to the vertexes 42 of the lenses 41, which are also arranged in zones, extended in the direction of the main optical axis 0. The condenser system 5 consists of more elements; the first element is a diverging one and is constructionally adapted in such a way that the main rays intersect approximately the centre of the plane of the light spot 6 and that the whole light beam passes the objective 7. The objective (hinder lens) is exchangeable. The light source 1 is then projected approximately in the middle of the objective 7 in a geometrical network, analogous to that of the main mirror 3, and of the raster lens 4 on a surface, where the ratio of the diameter of this beam and the distance of the plane of the light spot 6 from this bundle is approximately equal to or smaller than the value of the relative opening of the objective 7.

By the above described solution, higher luminous flux together with a uniformity ratio of illumination in the plane of the light spot 6 with the inserted slide is obtained, regardless of the shape and light distribution on the lighting area of the light source 1.

Figure 7:
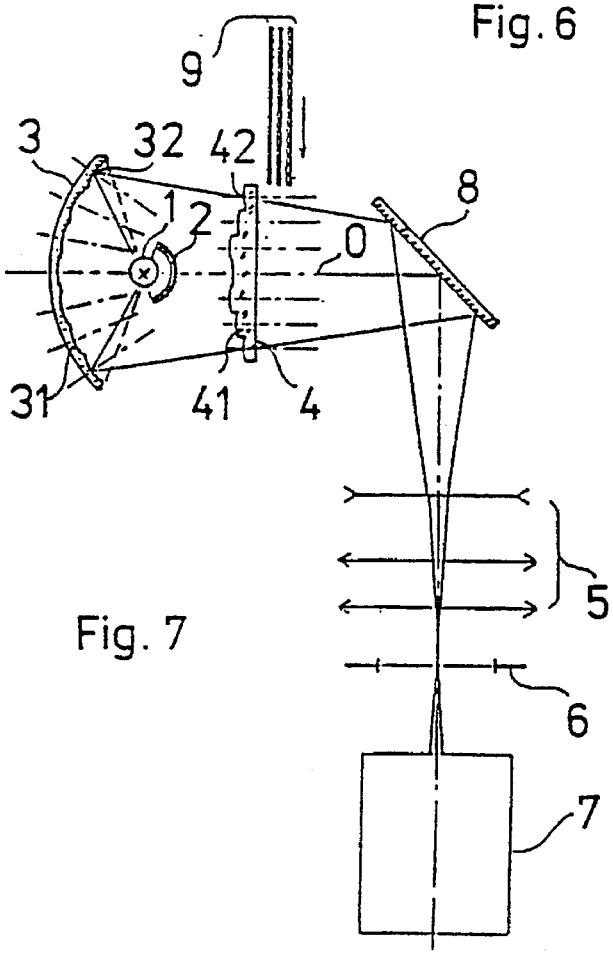
FIG. 7 is a schematic picture of a lighting system for an enlarging apparatus.

This system is almost identical with a lighting system for enlarging apparatuses with the possibility of slide projecting, as shown in FIG. 7. For slide projecting, the system turns through 90 degrees into the horizontal plane. The light source 1 is a halogen bulb. The system is completed with mirror 8, which directs the light beams into the vertical plane. The back element of the lens condenser 5 is exchangeable according to the type of the projecting objective 7. A piece of black and white or colour filmstrip or a slide is placed in the plane of the light spot 6. Filters 9 for a colour photograph are placed near the raster lens 4; when inserted, they change colour filtration. By a grey filter (not shown) and by a mechanical diaphragm (not shown), the light density of white and colour light is regulated. The main mirror 3 has a reflecting layer, which allows heat radiation to pass through.

In this case too, a great intensity of light with the input power 50 W is reached, the uniformity ratio of light distribution being retained at the same time as well, what is very important, expecially for colour photograph. Further advantage consists in that the system forms one structural unit both for magnifying black and white and colour photographs with a high luminous flux and for excellent slide projection.

The above described system provides some more possibilities of using of this newly designed lighting system, e.g., in the sphere of professional projecting and reprographical techniques.

I claim:

1. The lighting system for lighting apparatus for providing an intensive and uniform illumination in an area of a given size and at a given distance, comprising:

a light source for emitting light rays and generating a light flux, an auxiliary mirror having a first optical axis, a main mirror having a second optical axis, and a raster lens having a third optical axis with converging optical elements defining a first plurality of vertexes directing the light rays into a selected plane to create a light spot, wherein a reflecting area of said main mirror is created as a raster of concave spherical mirrors each having an optical axis converging with respect to the second optical axis where the concave spherical mirrors define a second plurality of vertexes having a shape of a rotational conic section with an axis of rotation identical with the second optical axis, the concave spherical mirrors being aligned with the second optical axis, said light source, and the auxiliary mirror, each of the concave spherical mirrors having a particular reflecting area with a focal length and projecting light rays from the light source to the first plurality of vertexes of the converging optical elements for of the raster lens, said converging optical elements for directing the projected light rays into the plane of the light spot.

2. The lighting system according to claim 1 where the converging optical elements are planoconvex lenses and the first plurality of vertexes are arranged in one plane which is perpendicular to the first optical axis, where the optical axes of said planoconvex lenses are parallel with the second optical axis.

3. The lighting system according to claim 1 where the converging optical elements each define a front surface and a back surface, where the front surface faces said main mirror and the back surface of each converging optical element is bevelled relative to an optical axis of each converging optical element.

4. The lighting system for lighting apparatus for providing an intensive and uniform illumination in an area of a given size and at a given distance, consisting of:

a light source for emitting light rays and generating a light flux;

an auxiliary mirror having a first optical axis;

a main mirror having a second optical axis; and a raster lens having a third optical axis with converging optical elements defining a first plurality of vertexes directing the light rays into a selected plane to create a light spot;

wherein a reflecting area of said main mirror is created as a raster of concave mirrors each having an optical axis converging with respect to the second optical axis where the concave mirrors define a second plurality of vertexes having a shape of a rotational conic section with an axis of rotation identical with the second optical axis the concave mirrors being aligned with the second optical axis, said light source, and the auxiliary mirror, each of the concave mirrors having a particular reflecting area with a focal length and projecting light rays from the light source to the first plurality of vertexes of corresponding converging optical elements of the raster lens, said converging optical elements directing the projected light rays into the plane of the light spot, and wherein the first optical axis lies along the second optical axis and that the light rays are directed in an imaginary plane defining a directed light field and in a direction of the second optical axis by every concave mirror of the main mirror, said imaginary plane being perpendicular to the second optical axis where said each of said concave mirrors having a size, a shape, and a plurality of side walls, and all of said concave mirrors having the same size and shape where said side walls tightly abut each other, each of said lenses having a size and a shape, and all of said lenses having the same size and shape and abutting tightly to each other by their side walls, and the shape and size of each particular lens of the raster lens corresponds to a shape and size of the directed light field, and where each concave mirror directs light from the light source to geometrically correspond to a location of said concave mirror in the main mirror.

5. The lighting system according to claim 4 where the converging optical elements are planoconvex lenses and the vertexes (42) of the lenses (41) of the raster lens (4) are arranged in one plane which is perpendicular to the first optical axis (0), where the optical axes (40) of said planoconvex lenses are parallel with the second optical axis.

6. The lighting system according to claim 4 where the converging optical elements each define a front surface and a back surface, where the front surface faces said main mirror and the back surface (43) of each converging optical element is angled relative to the third optical axis.

7. A lighting system for lighting fittings for providing an intensive and uniform illumination in an area of a given size and at a given distance, comprising:

a light source for generating light rays and an image field, an auxiliary mirror having a first optical axis, a main mirror having a second optical axis which is identical with the first optical axis, and a surface which is composed of a network of concave mirrors each having side walls, and a composite lens consisting of a network of converging lenses each of said lenses having side walls and is of substantially identical shape and size, where the converging lenses tightly abut along said side walls directing the light rays into a specific plane, where the light rays create a light spot, wherein vertexes of said concave mirrors are arranged on an imaginary surface which has a shape of a rotational conic section and an intersection of said imaginary surface with a meridian plane having a shape of a non-circle curve, said meridian plane being defined by each plane in which an axis of rotation of said rotational conic section is contained, each concave mirror defining a reflecting area and an optical axis, and having a focal length and directing an image of the light source onto a vertex of a geometrically corresponding converging lens of the composite lens, each geometrically corresponding converging lens projecting an image of a corresponding surface of said corresponding concave mirror of the main mirror into the plane of the light spot, and a shape and size of each converging lens of the composite lens correspond in shape and size to the image field of the light source and where each image of the light source, created by the particular concave mirror and converging lens geometrically corresponds to a location of said concave mirror in the main mirror.

8. The lighting system according to claim 7, wherein the concave mirrors are arranged in at least one group where said at least one group of concave mirrors has the same radius of curvature.

9. The lighting system according to claim 7, wherein the lenses are arranged in at least one group extending along the second optical axis and where each lens has a radius of curvature and the radius of curvature of the at least one group of lenses is the same.

10. The lighting system according to claim 7, wherein the converging lenses are planoconvex and the vertexes of the converging lenses are arranged in one plane which is perpendicular to the second optical axis, and optical axes of said converging lenses are parallel with the second optical axis.

* * * * *